United States Patent [19]

Robinson

[11] 4,036,496

[45] July 19, 1977

[54] BOWLING LANE CONDITIONING METHOD AND ARTICLE PRODUCED THEREBY

[76] Inventor: Raymond B. E. Robinson, 4241 NE. 19th Ave., Fort Lauderdale, Fla. 33308

[21] Appl. No.: 605,500

[22] Filed: Aug. 18, 1975

Related U.S. Application Data

[63] Continuation of Ser. No. 503,856, Sept. 6, 1974, abandoned, which is a continuation of Ser. No. 362,164, May 21, 1973, abandoned.

[51] Int. Cl.[2] ..... A63D 1/04

[52] U.S. Cl. ..... 273/51; 273/DIG. 29; 428/447; 106/287 SB; 427/387; 427/408

[58] Field of Search ..... 273/51, DIG. 29; 106/287 SB; 428/447

[56] References Cited

U.S. PATENT DOCUMENTS

| | | | |
|---|---|---|---|
| 2,812,263 | 11/1957 | Geen | 106/287 SB X |
| 3,012,987 | 12/1961 | Ansul | 273/51 UX |
| 3,071,479 | 1/1963 | Fulenwider | 106/287 SB X |
| 3,544,498 | 12/1970 | Holdstock et al. | 106/287 SB X |
| 3,670,049 | 6/1972 | Stein | 273/51 X |

*Primary Examiner*—Anton O. Oechsle
*Attorney, Agent, or Firm*—Malin & Haley

[57] ABSTRACT

A bowling lane including a wooden lane, a varnish layer on the top surface of the wooden lane, and a siloxane conditioning layer covering the layer of varnish from twenty to forty feet beyond the foul line. The siloxane layer may be a dimethylpolysiloxane of approximately 60,000 ctk's at 25° C initially blended with a carrier base oil such as kerosene.

2 Claims, 1 Drawing Figure

BOWLING LANE CONDITIONING METHOD AND ARTICLE PRODUCED THEREBY

This is a continuation of Application Ser. No. 503,856, filed Sept. 6, 1974, which is now abandoned, which in turn was a continuation of application Ser. No. 362,164, filed May 21, 1973, and now abandoned.

BACKGROUND OF THE INVENTION

This invention relates to a bowling lane including a wooden bowling lane, a varnish layer, and a dimethylpolysilozane conditioning layer.

In the past, amny bowling lanes were conditioned by oil placed on top of the varnish.

Bowling lane conditioning or dressing of lanes is important in bowling. Since friction is an ever-present factor in bowling, the constant roll of the bowling ball would quickly reduce an unconditioned wooden lane to splinters and chips. The wood would burn. Conditioning cannot be haphazard. In the past almost every bowling center oiled all lanes to inhibit wear and tear.

The application of the dressing, how the oil is placed on the lane, and where it is put down, and when, and its thickness, and the way the lane is polished (buffed) after its application are vital factors in a bowler's performance. If, for instance, the oil is appplied in such a manner as to leave some portions of the lane drier than another portion, the ball would grab quicker on the dry surface and the ball will hook.

Lanes are conditioned just over the foul line to a line from 20 to 40 feet beyond the foul line. No oil is applied beyond that point (40 feet) as a general rule, but that is not to say that no oil moves over the lane closer to the pins (60 feet from the foul line). The bowling ball will pick up oil on its constant path to the pins and deposit some of the picked up oil further than the point where the machine initially stops putting the oil down on the lane.

In that 20 to 40-foot conditioned area the ball will be in its skid, for it is virtually impossible to get it to start hooking toward the pocket. When the lane is used the oil shifts or breaks down. The lanes play differently each time the bowling ball is thrown on a lane conditioned by prior art materials.

BRIEF DESCRIPTION OF ONE EMBODIMENT

This invention is directed to an intergral bowling lane comprising a wooden bowling lane, a layer of varnish connected to the upper wooden bowling lane surface, and a siloxane conditioning layer connected to a portion of the upper surface. The siloxane layer may be initially placed on the polysiloxane may be approximately 60,000 ctk's 25° c. The dimethylpolysiloxane may initially be blended with a carrier base oil such as kerosene.

It is an object of this invention to provide a bowling lane comprising a wooden layer, a varnish layer, and a siloxane layer to protect and lubricate a portion of the lane surface.

Another object of this invention is to provide a siloxane layer that acts as a lubricant but reduces lubricant tracking beyond the coated surface area.

A further object is to provide a conditioning layer that will not break down quickly and that has a long life.

A further object is to provide a siloxane layer that gives the bowling lane an added gloss of long duration.

An additional object of this invention is to provide a conditioning layer that is not substantially affected by the normal ranges of temperature, humidity or heat.

In accordance with these and other objects which will be apparent hereinafter, the instant invention will now be described with particular reference to the accompanying drawing.

DESCRIPTION OF ONE EMBODIMENT

Figure 1:
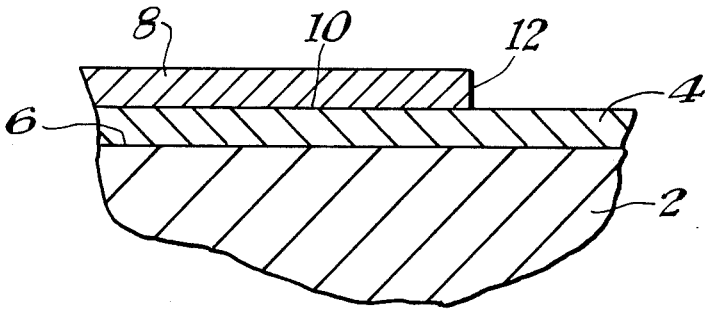
FIG. 1 is a corss-sectional view illustrating each layer of a portion of a bowling lane.

Referring now to the drawing, FIG. 1, a portion of the bowling lane is shown comprising a wooden layer 2, a varnished layer 4 on the upper surface 6 of the wooden layer 2, and a siloxane layer 8 on a portion of the upper surface of the varnish layer 10. The siloxane layer extends from the foul line to a condition line approximately 20 to 40 feet down the lane. The condition line edge is shown as numeral 12.

It should be noted that compounds of silicon, oxygen, usually also containing carbon and hydrogen, and containing in their molecules the structural unit R SiO in which R is usually $CH_3$ but may be H, $C_2H_5$, $C_6H_5$ or more complex substituents. Disoloxane ($H_3Si—O—SiH_3$) and trisiloxane ($H_3Si—O—SiH_2—O—SiH_3$) are the simplest examples, but the most interesting are those of higher molecular weight and having the composition ($R_2Sio$)n. These are polyorganosiloxanes or silicones (q.v.) whose molecules consist of chains of alternate silicon and oxygen atoms

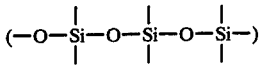

with the free valences of the silicon atoms joined usually to hydrocarbon (R) groups but also to some extent to oxygen atoms that are joined to (cross-linked) silicon atoms in a second chain. The properties of the resulting materials through oils, greases, rubbers, to resins or plastics, depending on the length of the chain, the nature of the R groups,, and the extent of crosslinking. In commercial silicones R is usually CH , i.e., they are methyl siloxanes.

One half pound of dimethylpolysiloxane fluid of 30,000 to 60,000 ctk's at 25° C, for example the trademarked product VASCASIL, is thoroughly blended with a vehicle, a slow drying odorless base oil or petroleum product. A fragrance may also be added. The vehicle may be chlorinated hydrocarbons. The vehicle evaporates and leaves a firm film of the Vascasil or siloxane on the upper surface 10 of the varnish layer. The siloxane layer protects the bowling lane varnish and wood and substantially reduces the tracking problem of prior art bowling alley conditioners.

What is claimed is:

1. A process of conditioning the finished surface of a bowling lane comprising:

applying a solution consisting essentially of dimethylpolysiloxane of not less than 30,000 centistokes measured at 25° C. in a volatile carrier to said surface, and allowing said carrier to evaporate following said application step so as to leave a uniform coating consisting essentially of said dimethylpolysiloxane on said finished surface.

2. In a finished bowling lane and lane conditioner combination the improvement comprising:

a thin conditioner layer consisting essentially of dimethylpolysiloxane of not less than 30,000 centstokes measured at 25° C.

* * * * *